US006296370B1

(12) United States Patent
Bamber et al.

(10) Patent No.: US 6,296,370 B1
(45) Date of Patent: Oct. 2, 2001

(54) MULTI-FUNCTION MODULAR STORAGE LIGHT UNIT

(75) Inventors: David Bamber, Kansas City, MO (US); Vincent Leung, Tsuen Wan (HK)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/369,552

(22) Filed: Aug. 6, 1999

(51) Int. Cl.[7] ..... F21L 4/00

(52) U.S. Cl. ..... 362/190; 362/191; 362/86; 362/156; 362/208; 362/253; 362/108

(58) Field of Search ..... 362/190, 191, 362/108, 103, 86, 154, 156, 253, 208

(56) References Cited

U.S. PATENT DOCUMENTS

| | | | | |
|---|---|---|---|---|
| D. 276,375 | | 11/1984 | Fenne | D26/44 |
| D. 283,254 | | 4/1986 | Fenne | D26/48 |
| D. 344,151 | | 2/1994 | Kwong | D26/42 |
| D. 416,343 | | 11/1999 | Dalton et al. | D26/37 |
| 4,447,863 | | 5/1984 | Fenne | 362/199 |
| 5,010,454 | | 4/1991 | Hopper | 362/487 |
| 5,558,430 | | 9/1996 | Booty, Jr. | 362/184 |
| 5,573,109 | * | 11/1996 | Isacson | 206/38.1 |
| 5,918,965 | * | 7/1999 | Ferrada | 362/191 |

* cited by examiner

*Primary Examiner*—Sandra O'Shea
*Assistant Examiner*—Ronald E. DelGizzi
(74) *Attorney, Agent, or Firm*—Kramer Levin Naftalis & Frankel, LLP.

(57) ABSTRACT

A multi-function modular storage light unit including a primary housing unit and detachable modules such as a radio and an auxiliary flashlight. The primary housing unit contains a spotlight, a power switch, and a handle to carry the unit. There is also a storage compartment built into the primary housing unit. The modules preferably include belt clips for hands-free transport. The modules are removably attached to the primary unit by way of an attachment mechanism which may include alignment features and a latching mechanism. The modules may alternatively be removably attached by their belt clips to sleeves arranged on the primary housing. Each of the detachable modules and the spotlight is independently powered.

16 Claims, 12 Drawing Sheets

MULTI-FUNCTION MODULAR STORAGE LIGHT UNIT

FIELD OF THE INVENTION

The present invention relates to portable light units, in particular to a multi-function portable light unit.

BACKGROUND INFORMATION

In general, lights or flashlights used in combination with radios or other auxiliary flashlights are well known. These type of multi-function light units may contain several different functions (i.e., radio, flashlight, tape recorder, siren, etc.). However, each of these different functions are either built into or permanently integrated into the housing unit of the light. In other words, a user cannot separate one functional component from another. Therefore, if the user carried this multi-function light unit to a park, and wanted to detach, for example, the radio to be used in a separate area of the park, the user would not be able to do so because the radio is built into or is permanently integrated into the multi-function light unit. Thus, the user must always bring along the entire multi-function light unit wherever the user chooses to go.

Furthermore, none of these conventional multi-function light units contain any useful storage compartment. Instead, these designs attempt to utilize any space available for a particular function such as a radio, another flashlight, etc. Therefore, when the user would like to store small valuables such as first aid items or spare keys, the user must store those items in his or her pocket, or find another place to store those items.

SUMMARY OF THE INVENTION

The present invention solves the problem of having to carry the entire multi-function light unit everywhere with the user by providing a multi-function light with detachable modules which can be conveniently separated from the primary multi-function light housing unit. Detachable modules in accordance with the present invention include a radio and an auxiliary flashlight. Each module may include a belt clip, so that the user can carry the module hands-free.

In an exemplary embodiment, the detachable modules are removably attached with a latching mechanism to the primary housing unit. In a further exemplary embodiment, the detachable modules are removably attached to the primary housing unit by the belt clips on the modules.

The present invention also allows users to store small valuable items by providing a storage compartment within the primary housing unit.

DETAILED DESCRIPTION OF THE INVENTION

The present invention relates to a multi-function modular storage light unit 1 which comprises a primary housing unit 2 and detachable modules 5, which fit and/or attach to the primary housing unit 2.

Figure 1:
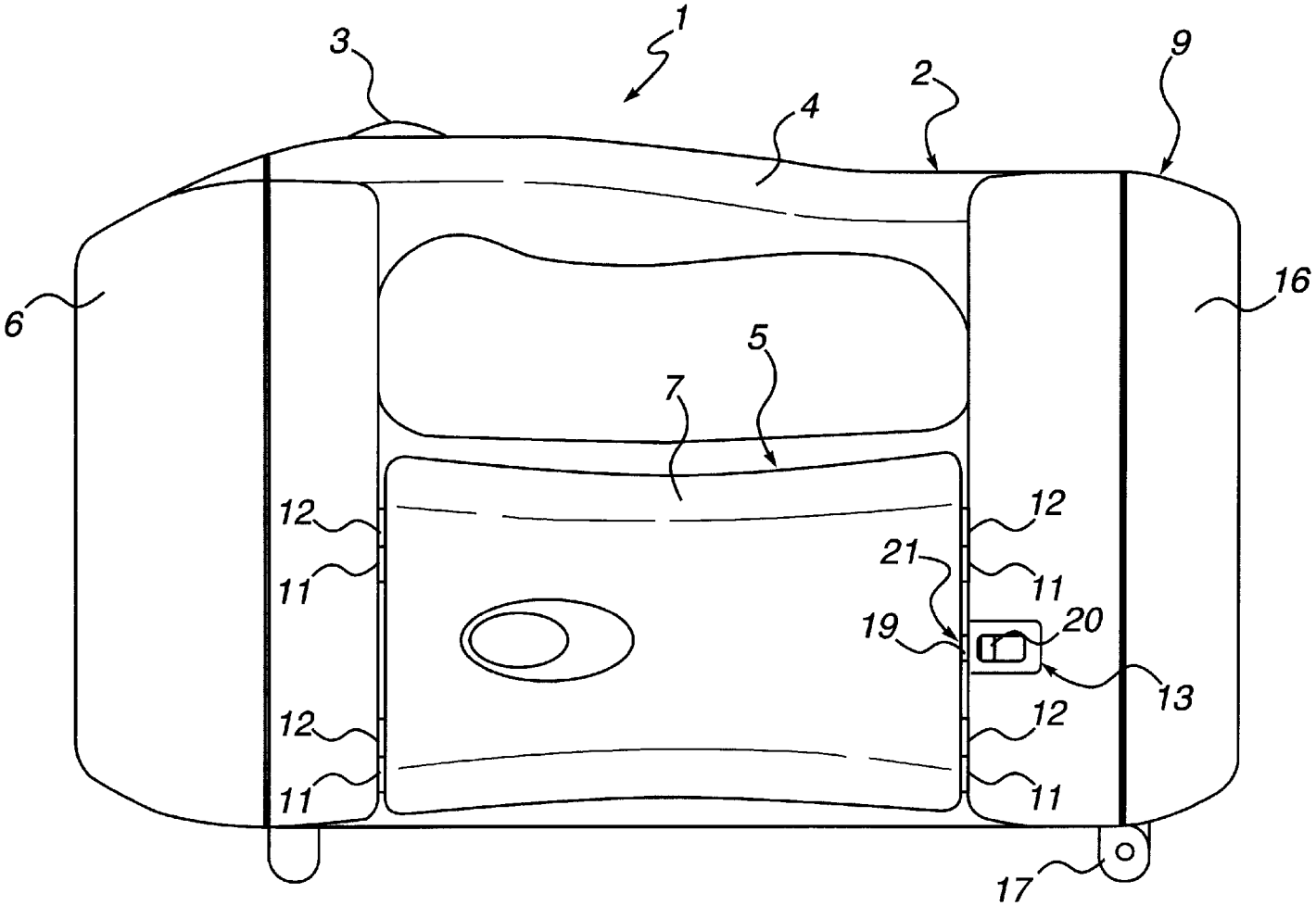
FIG. 1 is a side view of an exemplary embodiment of a multi-function modular storage light unit in accordance with the present invention.
Figure 2:
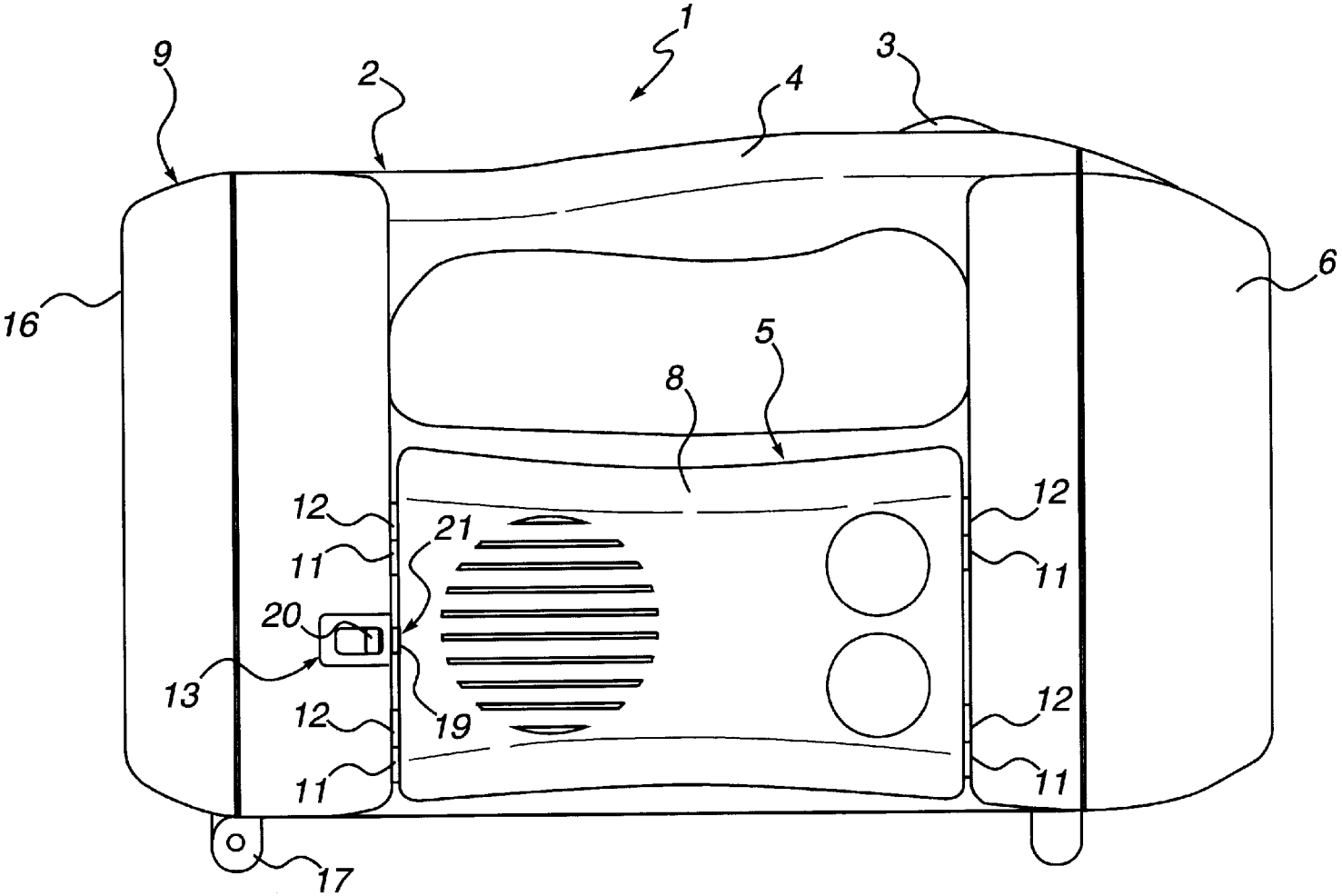
FIG. 2 is a side view of the multi-function modular storage light unit of the side opposite from that of FIG. 1.
Figure 3:
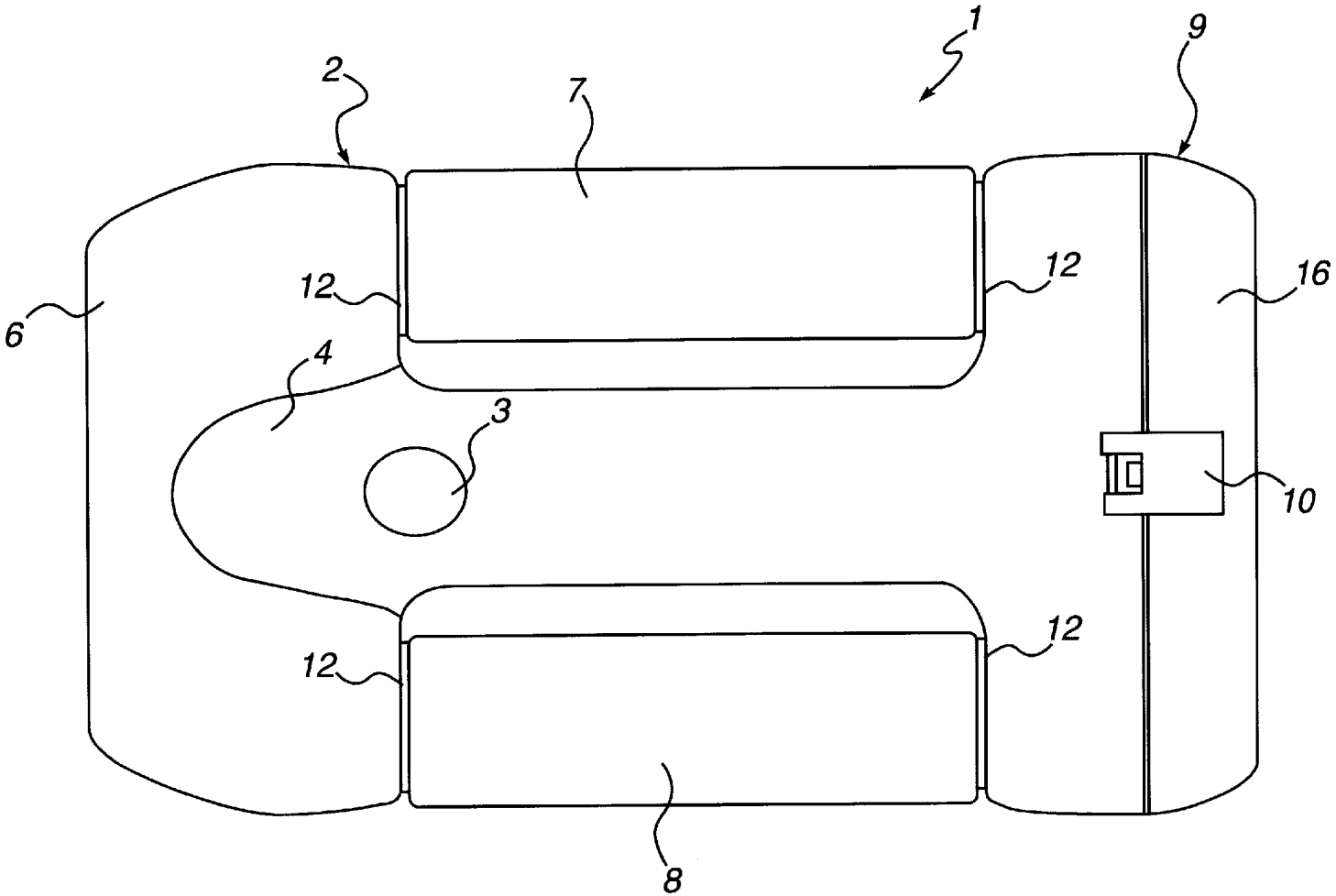
FIG. 3 is a top view of the multi-function modular storage light unit of FIGS. 1 and 2.
Figure 4:
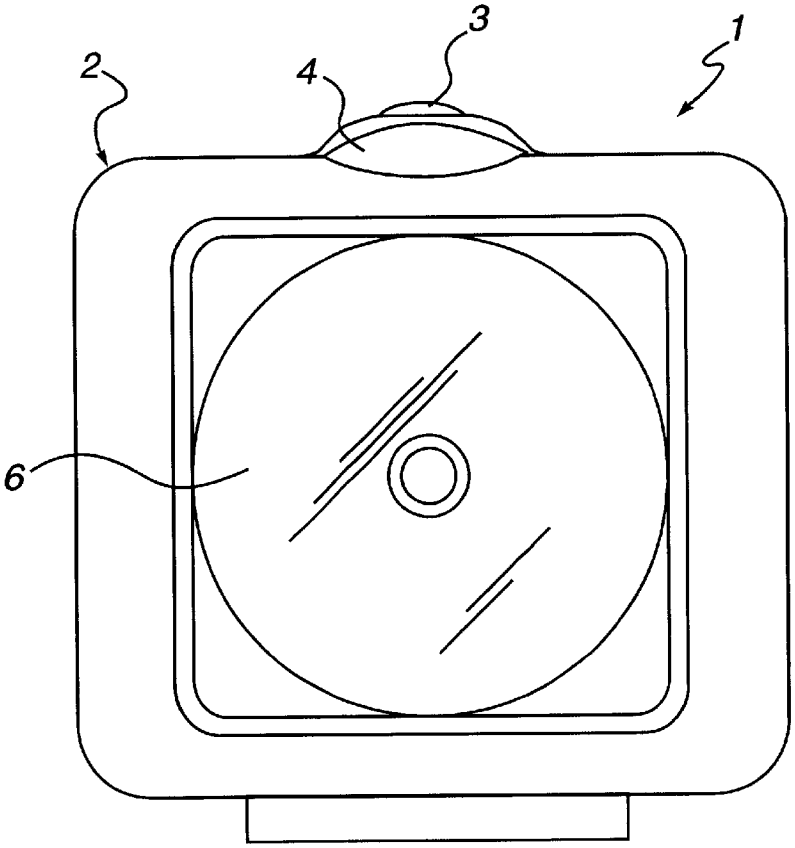
FIG. 4 is a front view of the multi-function modular storage light unit of FIGS. 1–3.
Figure 10:
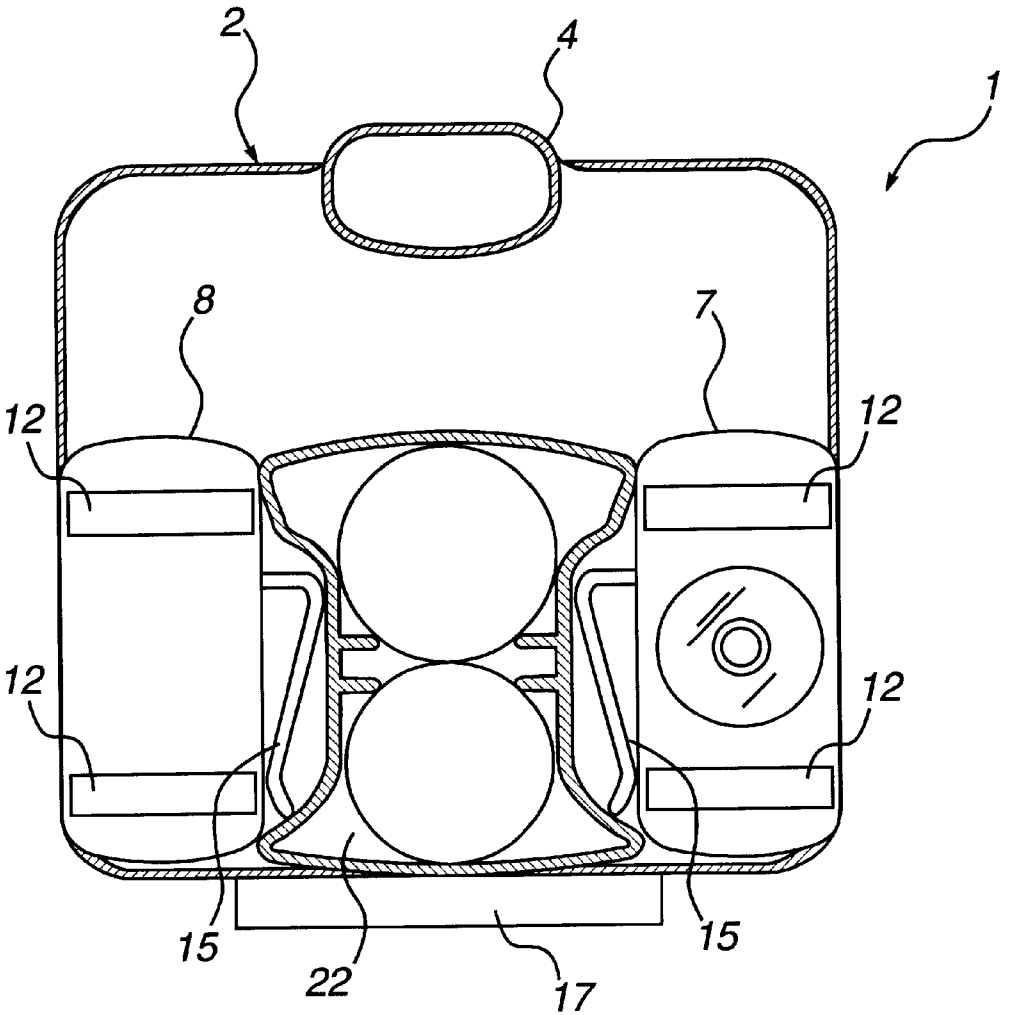
FIG. 10 is a cross sectional view of the multi-function modular storage light unit.

The primary housing unit 2 may be of an ergonomic design. As shown in FIGS. 1 and 2, the primary housing unit comprises a handle 4 and a spotlight 6. The handle 4 is preferably also of an ergonomic design that will allow the user to comfortably grip the handle, but may be of any design known to the art. A power switch 3 is included for turning the spotlight 6 on or off. The power switch may also be designed to adjust the power of the spotlight. Any spotlight as known in the art may be used. Preferably, a spotlight with a krypton bulb that gives a powerful broad light beam is used. The spotlight 6 may be powered by batteries, which are located in the battery compartment 22 of the primary housing unit (see FIG. 10), or by any other electrical power means known in the art.

Figure 5:
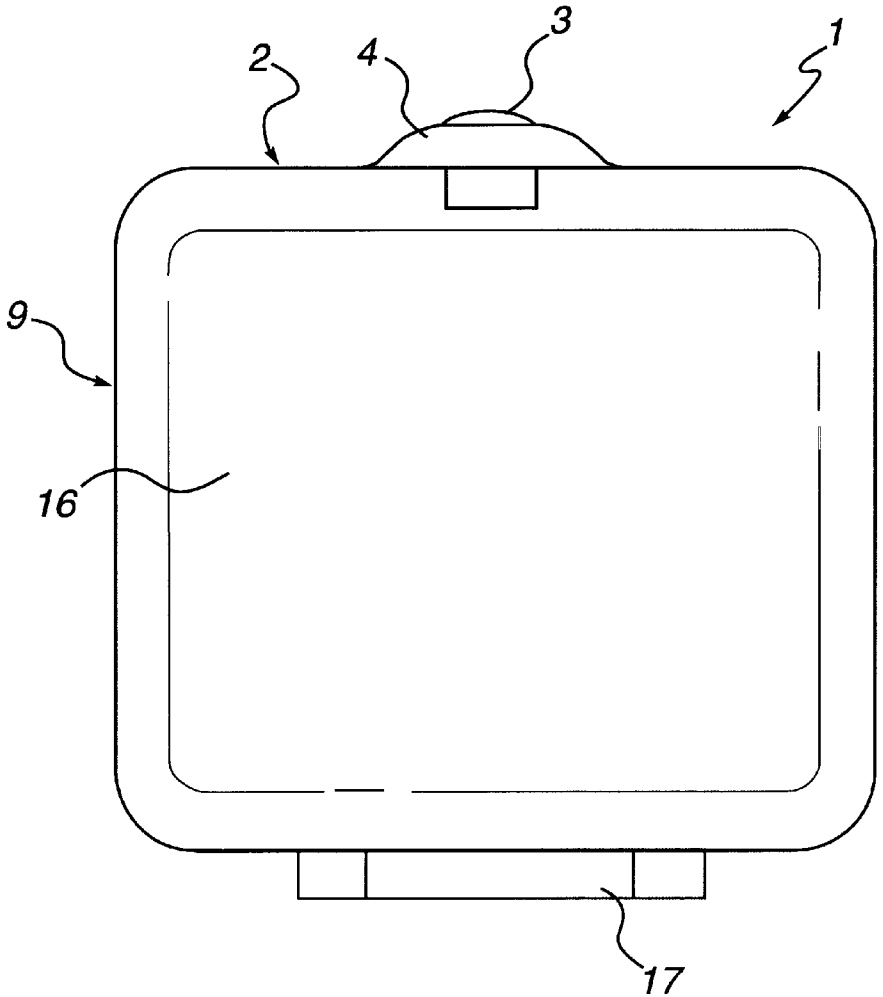
FIG. 5 is a rear view of the multi-function modular storage light unit of FIGS. 1–4.
Figure 6:
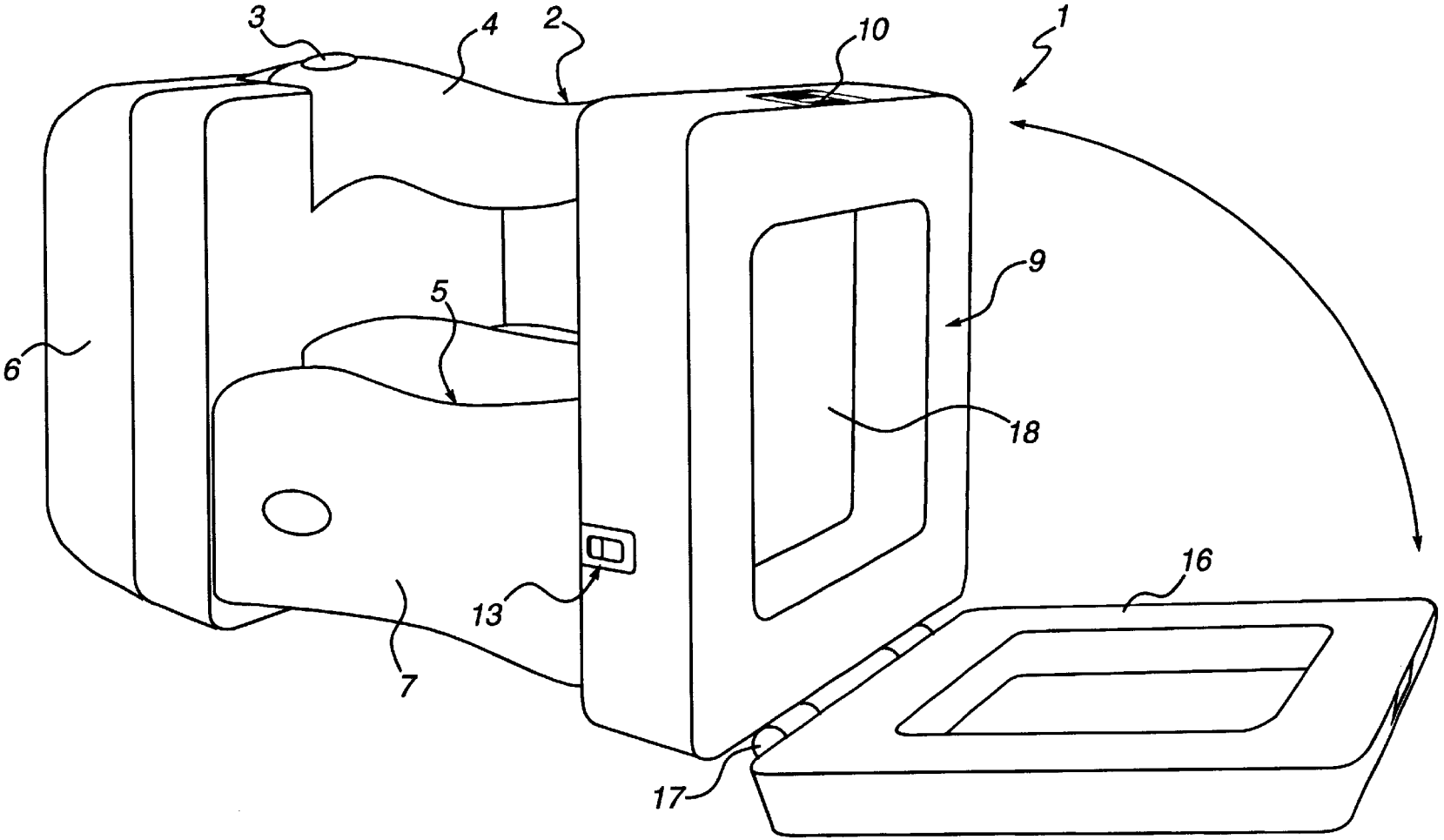
FIG. 6 is a perspective rear side view of the multi-function modular storage light unit of FIGS. 1–5, with the storage compartment door in an open position.

Furthermore, the primary housing unit 2 preferably contains a storage compartment 9 to allow the user to store small items. To maximize the space available, the storage compartment 9 is located on the primary housing unit 2 on the end opposite from the spotlight 6. The storage compartment comprises a space 18 for holding small items, such as first aid or valuable items. The space 18 is enclosed by a storage compartment door 16. The storage compartment door 16 may be attached to the primary housing unit 2 by a hinged connection 17 which allows the storage compartment door 16 to be moved into an open position (as shown in FIG. 6) to expose the space 18 or a closed position (as shown in FIG. 5) to cover the space 18. When moved into the closed position, the storage compartment door 16 may be further secured to the primary housing by a locking mechanism 10. Additionally, it is preferred that the storage compartment door 16 be designed so it forms a water-tight seal to prevent or minimize any liquid from reaching the items in space 18 when the door 16 is in the closed position.

In an exemplary embodiment, the detachable modules 5 include a detachable radio module 8 and a detachable auxiliary flashlight module 7. By providing detachable modules, the present invention allows the user to carry the radio 8, for example, without having to take the entire primary housing unit 2 with the user wherever the user chooses to go. The user is free to choose whether to take just one or two of the detachable modules 7 and 8, or to bring along the entire multi-function modular storage light unit 1.

Moreover, each of the detachable modules 7 and 8 is powered by its own power source, such as separate batteries in its own battery compartment (not shown), or by any other method known in the art. A separate power switch is provided on each of the detachable modules 7 and 8 for operating the respective module. By individually powering each module 7 and 8, the user may still use the detachable modules 7 and 8 even if the main power source to the spotlight 6 fails.

Figure 9:
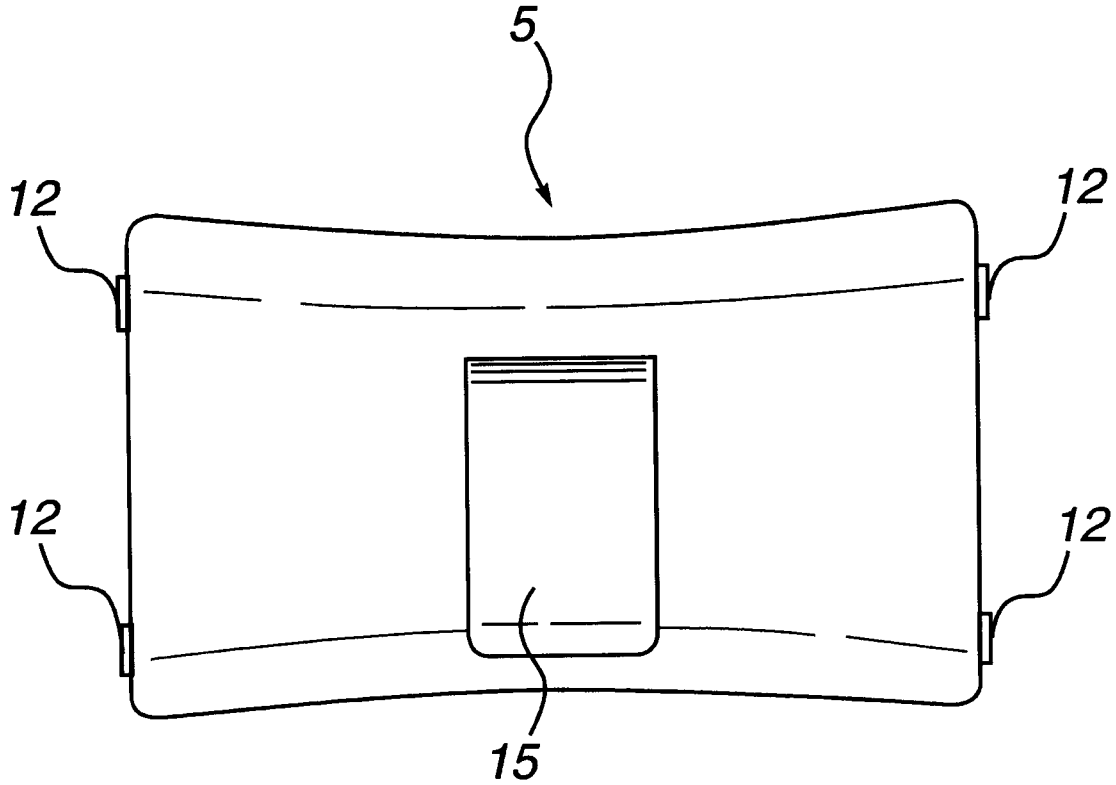
FIG. 9 is a view of a side of a detachable module which faces the main unit when attached to the multi-function modular storage light unit.

Furthermore, as shown in FIG. 9, each detachable module 5 preferably includes a belt clip 15 attached thereto. The belt clip 15 allows the user to carry the detachable module hands-free by simply clipping the module onto a belt, pocket or any other item. The belt clips 15 may be attached to the modules, such as by screws or by any other means known in the art, or may be integrated with the module housings.

Figure 7:
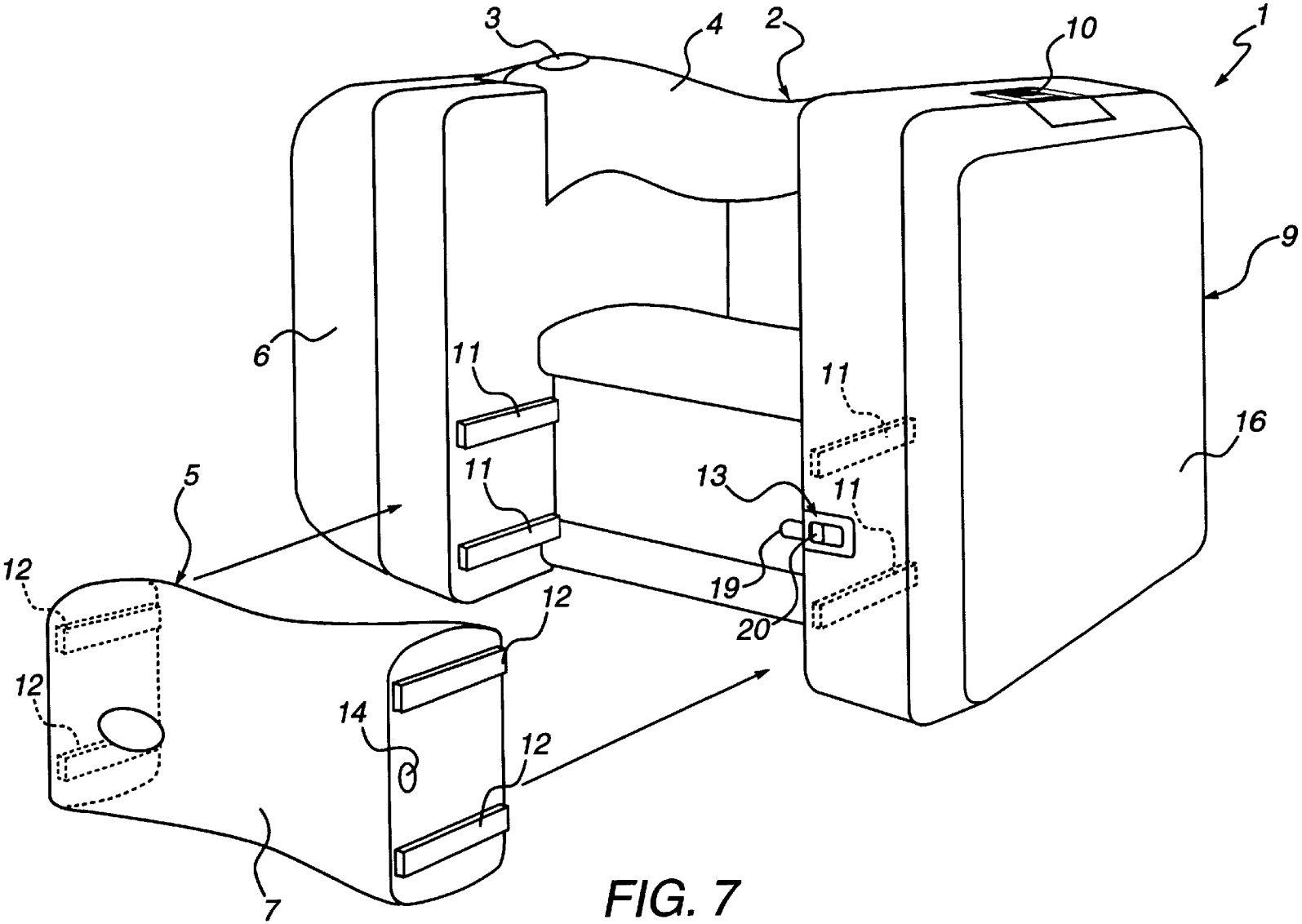
FIG. 7 is a perspective side view of the multi-function modular storage light unit of FIGS. 1–6, showing a detachable module detached from the main unit.
Figure 8:
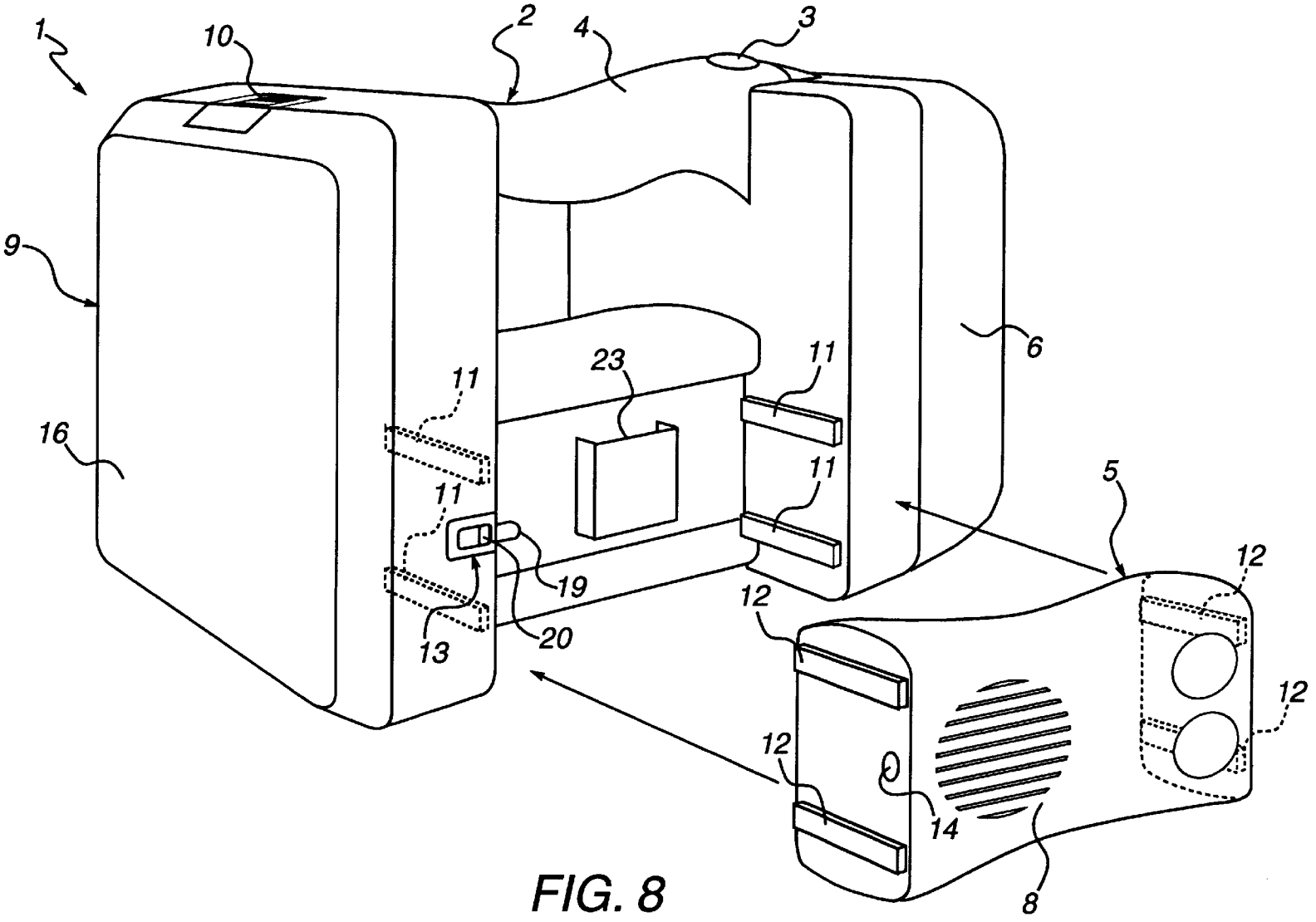
FIG. 8 is a perspective side view of the multi-function modular storage light unit of FIGS. 1–7, showing a detachable module detached from the main unit.

A mechanism for attaching the modules 5 to the primary housing 2 will now be described with reference to FIGS. 7 and 8. In the preferred embodiment, guiding means are provided to allow the modules to be aligned properly and consistently anytime the modules are to be reattached to the primary housing unit. FIGS. 7 and 8 illustrate that such guiding means may include a series of rails 12 located on the detachable modules 7 and 8 and as well as corresponding rails 11 located on the primary housing unit 2. When the detachable modules 7 and 8 are properly aligned, the rails 12 on the detachable modules 7 and 8 straddle the corresponding rails 11 of the primary housing unit 2, as shown in FIGS. 1 and 2. In the alternative, the rails 11 and 12 may be arranged so that the rails 11 straddle the rails 12.

Once the detachable modules 7 and 8 have been positioned to be secured to the primary housing unit 2, a latching mechanism 13 is used to further accomplish the attachment. In the preferred embodiment, the latching mechanism for each module includes a projection 19 which slidably projects horizontally outward from the primary housing 2 into the cavity into which the module 5 is to be received. The projection 19 is attached to a knob 20 on the side of the primary housing 2 by which a user can slide the projection 19 into and out of the receiving cavity. The projection 19 is preferably biased, such as by a spring (not shown), to project into the receiving cavity.

To attach the module 5 to the primary housing, the user pulls back the projection 19 via the knob 20 and slides the module on the rails 11 into the receiving cavity. Once the module 5 is fully seated in the cavity, the projection 19 is slid forward (either by sliding the knob 20 or releasing the knob, if spring loaded) and is received in a corresponding opening 14 in the module housing. The opening 14 aligns with the projection 19 when the module 5 is properly positioned for attachment to the primary housing unit 2. Once the projection 19 is in the corresponding opening 14, the detachable module 5 is securely attached to the primary housing unit 2.

Although the latching mechanism 13 is shown on the back portion of the housing 2, it can also be arranged on the front end. Moreover, it may be possible to eliminate the sets of rails 11 and 12 on the side of the module 5 which receives the projection 19.

An alternative guiding arrangement is shown in FIGS. 13A–13D. In this embodiment, one or more rails 11 are arranged on the primary housing 2 opposite from the latching mechanism 13. The module 5 includes one or more recesses 120 which correspond to the one or more rails 11 on the housing. An opening 14 corresponding to the projection 19 of the latching mechanism 13 is arranged on the opposite end of the module 5.

Several alternative arrangements are possible within the scope of the invention. For example, one or more additional rails 11 may be arranged on the housing 2 on the opposite side of the module receiving cavity, with a corresponding one or more additional recesses 120 arranged on the opposite end of the module 5. Furthermore, any combination of rails and corresponding recesses may be provided on the primary housing 2 and each module 5 (e.g., rails on the modules and recesses on the primary housing; a rail on one end of the module and a recess on the other end; a recess and a rail on one end of the module and a recess and a rail on the other end, etc.) Moreover, the latching mechanism 13 may be arranged on the module 5 and the corresponding opening 14 may be arranged on the primary housing 2.

In an alternative embodiment, the detachable modules 7 and 8 may be attached to the primary housing unit 2 by using the belt clip 15 as an alternative latching mechanism. In this embodiment, a sleeve 23 for receiving the belt clip 15 therein is provided on the inner wall of the module receiving cavity, as shown in FIG. 8. A module 5 is thus attached to the primary housing 2 by clipping it via its respective belt clip to the sleeve 23.

Figure 12:
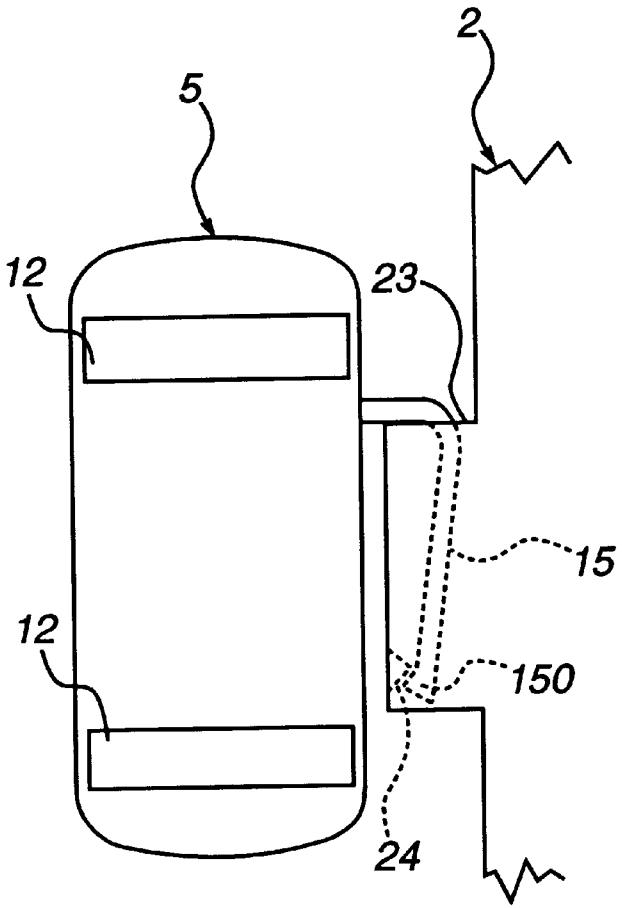
FIG. 12 is a cross sectional view of a detachable module attached to a closed pocket attachment sleeve of the primary housing unit.
Figure 11:
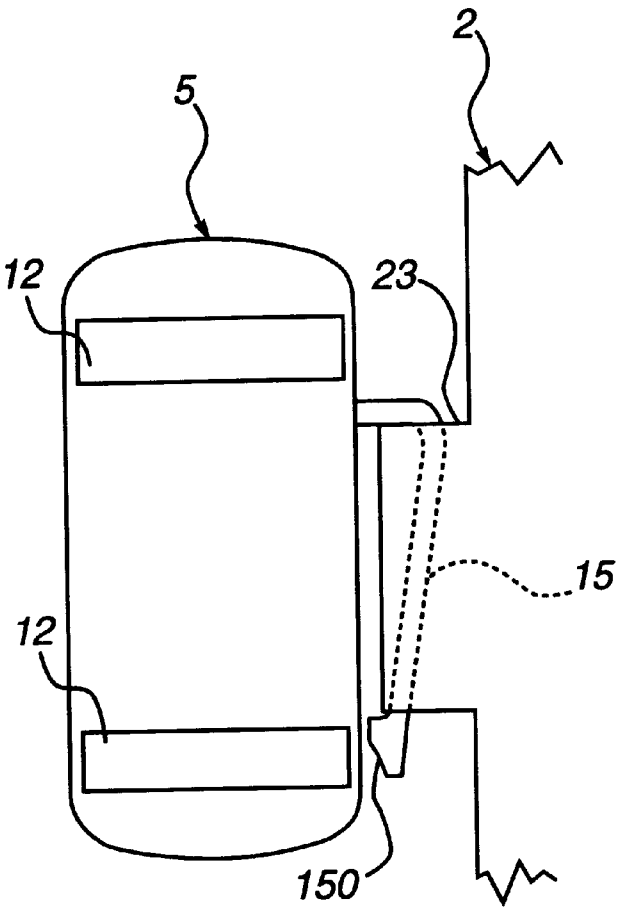
FIG. 11 is a cross sectional view of a detachable module attached to an open pocket attachment sleeve of the primary housing unit.
Figure 13B:
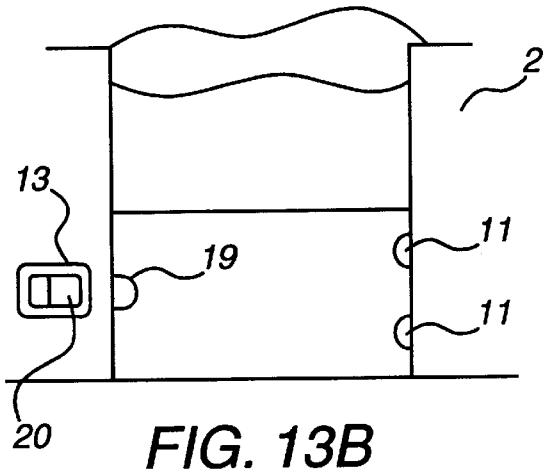
FIG. 13B is side view of the primary housing unit of FIG. 13A.
Figure 13C:
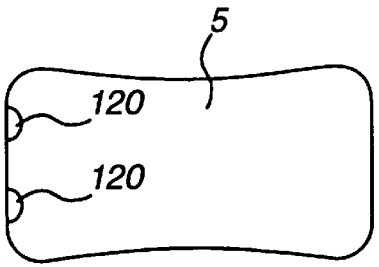
FIG. 13C is a front view of a detachable module of FIG. 13A.
Figure 13A:
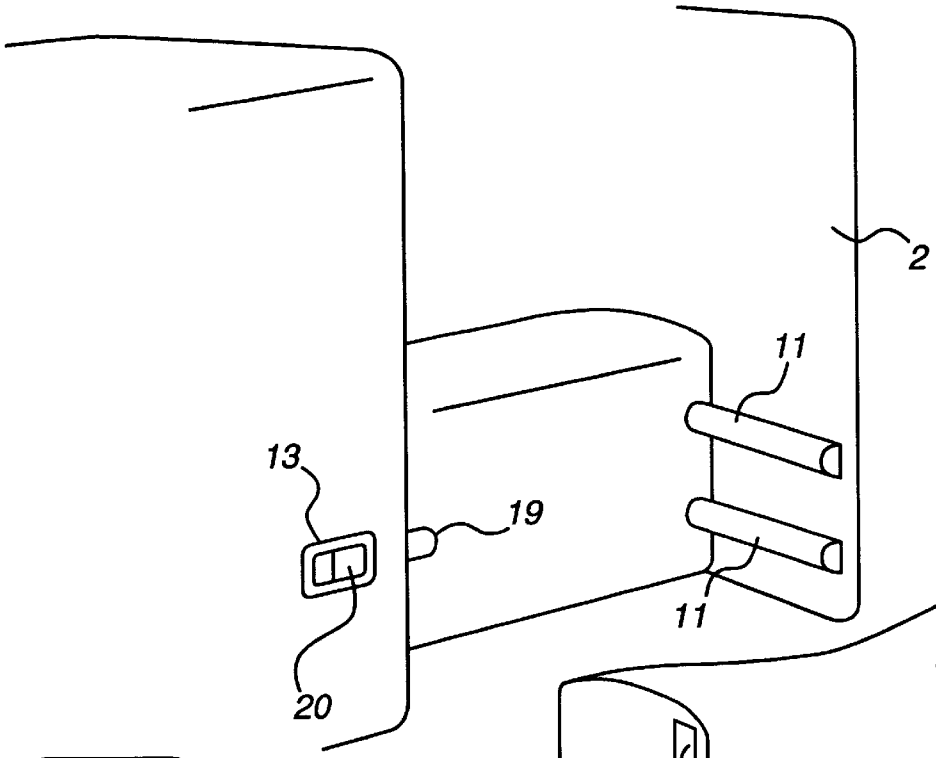
FIG. 13A is a perspective side view of an alternative embodiment of the multi-function modular storage light unit.
Figure 13D:
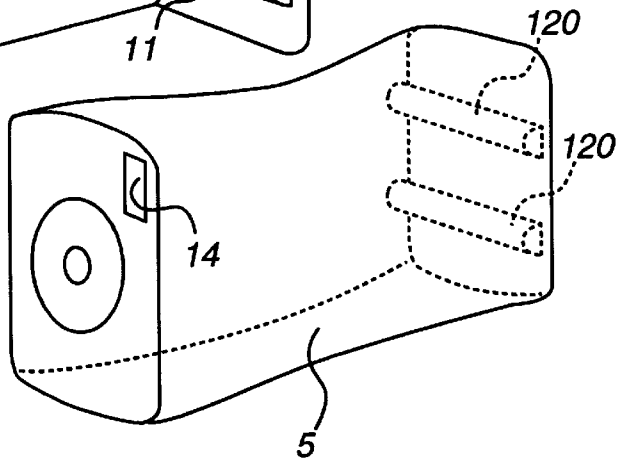
FIG. 13D is a side view of a detachable module of FIG. 13A.
Figure 13D:
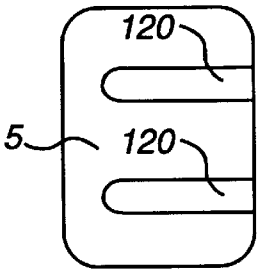

Alternative embodiments for the sleeve 23 are shown in FIGS. 11 and 12. As shown in FIG. 11, the sleeve 23 may be an open pocket sleeve, whereby the clip 15 passes through the sleeve 15. The belt clip preferably comprises a barb 150 at its free end. In the embodiment of FIG. 11, when fully seated in the sleeve 23, the barb 150 catches on the bottom rim of the sleeve, thereby securing the belt clip 15 in the sleeve 23.

As shown in FIG. 12, the sleeve 23 may include a ridge 24 in its interior which engages the barb 150 of the clip 15.

Those skilled in the art will realize that various changes and modifications may be made to the invention without departing from the spirit of the invention and it is intended to claim all such changes and modifications as falling within the scope of the invention.

What is claimed is:

1. A multi-function modular light unit comprising:

a primary housing unit, the primary housing unit including:

a light-emitting device, a handle, and a power supply;

at least one module; and an attachment mechanism, the attachment mechanism removably attaching the at least one module to the primary housing unit.

2. The multi-function modular light unit of claim 1, wherein the primary housing unit includes a switch for selectively powering the light-emitting device with the power supply.

3. The multi-function modular light unit of claim 1, wherein the primary housing unit includes a storage compartment.

4. The multi-function modular light unit of claim 1, wherein the at least one module includes a radio.

5. The multi-function modular light unit of claim 1, wherein the at least one module includes a flashlight.

6. The multi-function modular light unit of claim 1, wherein the at least one module includes a radio module and a flashlight module.

7. The multi-function modular light unit of claim 1, wherein the at least one module includes a belt clip.

8. The multi-function modular light unit of claim 1, wherein the attachment mechanism includes:

a latching mechanism, a first alignment feature, the first alignment feature being arranged on the primary housing unit, and a second alignment feature, the second alignment feature being arranged on the module, wherein the first and second alignment features engage to align the module with the primary housing unit.

9. The multi-function modular light unit of claim 8, wherein the first alignment feature includes a first pair of rails and the second alignment feature includes a second pair of rails, the first and second pairs of rails being arranged so that one pair straddles the other pair when the module is aligned with the primary housing unit.

10. The multi-function modular light unit of claim 8, wherein the first alignment feature includes a rail and the second alignment feature includes a recess, the recess receiving the rail therein when the module is aligned with the primary housing unit.

11. The multi-function modular light unit of claim 8, wherein the first alignment feature includes a recess and the second alignment feature includes a rail, the recess receiving the rail therein when the module is aligned with the primary housing unit.

12. The multi-function modular light unit of claim 8, wherein the latching mechanism includes a projection which slides into a corresponding opening in the at least one module when the module is attached to the primary housing unit.

13. The multi-function modular light unit of claim 7, wherein the attachment mechanism includes a sleeve arranged on the primary housing unit to which the belt clip on the at least one module may attach.

14. The multi-function modular light unit of claim 13, wherein the sleeve includes a ridge for engaging the belt clip of the at least one module.

15. The multi-function modular light unit of claim 3, wherein the primary housing unit includes a storage compartment hatch for removably enclosing the storage compartment.

16. The multi-function modular light unit of claim 15, wherein the storage compartment hatch is hingedly attached to the primary housing unit.

* * * * *